United States Patent [19]

Roca-Nierga

[11] Patent Number: 4,486,155

[45] Date of Patent: Dec. 4, 1984

[54] CONTROL OF THE PISTONS IN INJECTION PUMPS OF INTERNAL-COMBUSTION ENGINES

[75] Inventor: Manuel Roca-Nierga, Barcelona, Spain

[73] Assignee: Spica S.p.A., Italy

[21] Appl. No.: 384,209

[22] Filed: Jun. 2, 1982

[30] Foreign Application Priority Data

Jun. 6, 1981 [DE] Fed. Rep. of Germany ..... 3122703

[51] Int. Cl.[3] ..... F04B 9/04

[52] U.S. Cl. ..... 417/500; 123/449

[58] Field of Search ..... 123/449, 450; 417/500, 417/516, 517, 519

[56] References Cited

U.S. PATENT DOCUMENTS

| | | | |
|---|---|---|---|
| 2,351,908 | 6/1944 | Beeh | 123/449 X |
| 2,746,443 | 5/1956 | Meyer | 123/449 |
| 2,965,087 | 12/1960 | Bischoff et al. | 123/449 X |
| 4,108,130 | 8/1978 | Bailey | 123/450 |

FOREIGN PATENT DOCUMENTS

| | | | |
|---|---|---|---|
| 598280 | 5/1960 | Canada | 123/450 |
| 493422 | 10/1938 | United Kingdom | 123/449 |

*Primary Examiner*—Leonard E. Smith

*Attorney, Agent, or Firm*—Diller, Ramik & Wight

[57] ABSTRACT

This invention suggests to provide an injection pump for internal-combustion engines, in which the rotary motion of the distributor piston (23) has a speed slower than the relative speed of the cam members (16, 17) which control the axial piston stroke in order to improve the working conditions of said cam members (16, 17) and to increase the pumping speed of the piston.

36 Claims, 4 Drawing Figures

CONTROL OF THE PISTONS IN INJECTION PUMPS OF INTERNAL-COMBUSTION ENGINES

This invention relates to fuel injection pumps for internal-combustion engines, of the kind comprising a distributing member which, arranged coaxially with the input drive shaft of the pump and with the complementary cam members equipping the same shaft, provides to the timing of the delivery of fuel to the several cylinders of the engine.

Pumps are already known which, with the aid of a front cam acting upon properly arranged followers, are capable of providing the to-and-fro motion in an accurate way for injection.

A drawback of the contemporary art is that such pumps must rotate at one half the revolutions of the four-stroke engines, in order to feed thereby, at a single revolution of the pump, all the cylinders of the internal-combustion engine: the latter, meanwhile, will have gone through two complete revolutions. By so doing, the injection velocities which can be obtained with a particular follower-cam assembly are, obviously, halved, the cam slope being the same.

At present, and due to the necessity of obtain valid power savings in the internal-combustion engines, provision should be made for increasing the injection velocity of the pump connected thereto, inasmuch as an increase of the injection velocity permits to improve both the injection pressures and the atomization of the fuel jet within the engine, so that the efficiency of the combustion may correspondingly be improved.

This invention aims to doing away with the drawback of the limitation of the injection velocity of the pumps having a distributor with its axis of rotation coinciding with the axis of rotation of the drive input shaft, the limitation in question deriving from the limits imposed to the cam slope, the latter being imposed by the requirement of reducing the transversal stresses upon the cam follower.

To this purpose, the invention suggests to provide an injection pump of the kind comprising an element for distributing fuel to the several engine cylinders, said element being arranged coaxially with the drive input shaft of the pump and also with the axis of rotation of the complementary cam member with which the pump is provided, characterized in that either of said complementary cam members is mechanically linked to said distributing element to have it rotated at an angular speed which is slower than the velocity of the relative motion of the cam members the one relative to the other.

In order that the objects and the features of the present invention may be better appreciated in connection with their essentials, a few exemplary embodiments of the invention will now be described hereinafter, the description being aided by the accompanying drawings, wherein.

Figure 1:
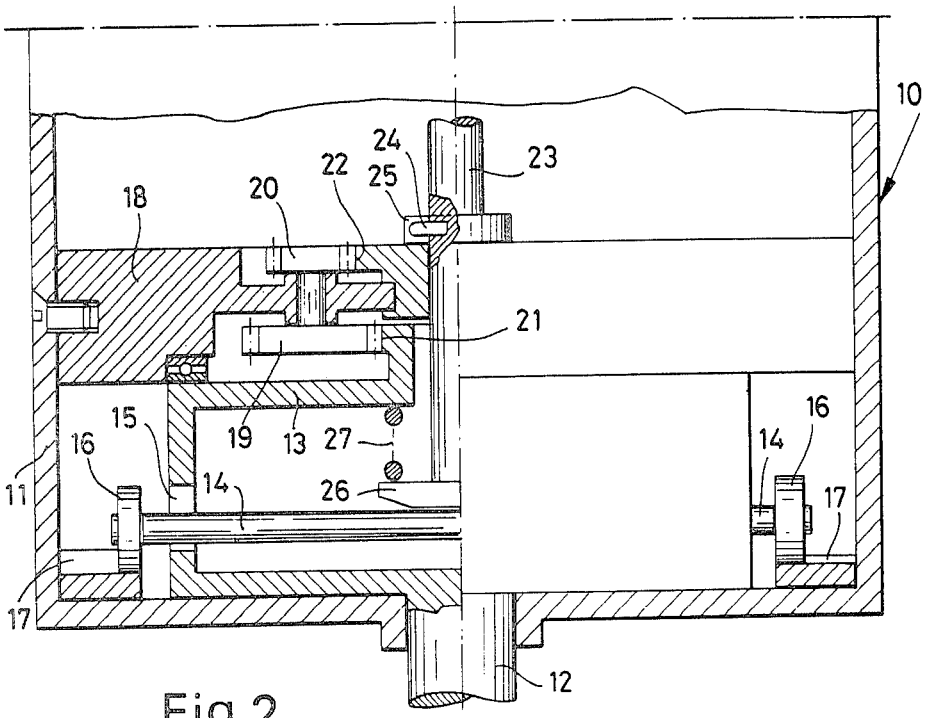
FIG. 1 is a partially cross-sectional view of the pump made according to this invention.

An injection pump 10 is shown fragmentarily, just to make conspicuous the mechanical details to which the invention is quite particularly directed.

A pump casing 11 is shown, which supports for rotation the drive input shaft 12: the shaft is extended to form a cylindrical portion 13 through which an arm 14 is caused to pass in correspondence with longitudinal slots 15. On the ends of the arm 14 followers 16 are mounted, which run along a cammed pathway 17 bonded to the pump casing 11.

A peripheral ring 18 secured to the casing 11 carries for rotation gear couples 19 and 20, one of which is shown in the drawings. The gear 19 is in mesh with the ring gear 21 formed on the element 13, whereas the gear 20 engages the ring gear 22, the latter being secured for rotation to the stem 23 of a distributor piston of the pump: it has been shown only partially because it is known as such. The stem 23 can, however, be moved axially relative to the ring gear 22 by virtue of the free motion of the dowel 24 in the slot 25 of the ring gear. This coupling is a diagrammatical showing of any conventional coupling device.

The stem 23 of the distributor piston is terminated by a dish 26 resting against the arm 14 as urged by the spring 27. Thus, in the case in point, the piston stem has a reciprocal motion which is the result of the displacement of the followers 16 on the cam 17, whereas it has a rotational motion which is due to the drive of the shaft 12, received through the gear system 21-19-20-22.

Assuming that the shaft 12 is driven to rotation at a speed equal to that of a drive shaft of an internal combustion engine of the 4-stroke type, and assuming also that the distributor piston of the pump 10 has quite conventional a configuration, the ratio for that gear system will be 2:1 in total so as to have the stem 23 rotated at an angular speed equalling one half that of the drive shaft.

However, the cam member which lifts the piston has an angular speed which is twice that it would have if solidly secured to the piston stem, according to the common technical teachings.

The result is that, for the same ascending slope of the cam race 17, the velocity at which the piston is lifted is doubled and the same is true for the velocity of injection, according to the objects of the invention.

It is apparent that the kinematic linkage between the distributing element and the cam assembly which lifts the piston can be varied so as to maintain between these component parts the desired angular speed ratio.

Figure 2:
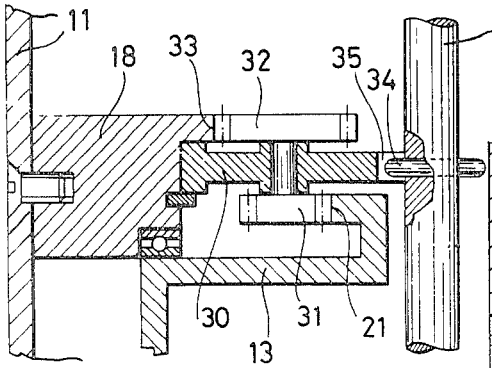
FIGS. 2 and 3 are views akin to that of FIG. 1 and show a few details of different embodiments of the pump in question.

To this purpose, FIG. 1 shows a simple transmission system with two couples of gears: another embodiment, using an epicyclical gear train is shown in FIG. 2.

The latter figure of the drawings shows only partially the portion of pump shown in FIG. 1 and equal reference numerals connote corresponding component parts.

The driving connection between the stem 23 and the member 13 is embodied by a planet-carrier 30 on which gears 31 and 32 are mounted pairwise. The gear 31 meshes with the ring gear 21 of the member 13, whereas the gear 32 meshes with the fixed ring gear 33. The stem 23 of the distributor piston is driven to rotation by the engagement of its dowel 34 with the slot 35 of the planet carrier 30.

By properly sizing the gear train 21, 31, 32 and 33 it is possible to obtain the drive-transfer ratio (reduction) which is the most desirable between the shaft 12 and the stem 23 of the rotary distributor piston.

The magnitude of this ratio can be 2:1, that is, an angular speed of the shaft 12 equal to twice the angular speed of the piston, and, more particularly, when the number of cylinders of the engine fed by the distributor element terminated by the stem 23 is an even number.

Different ratios can be selected, if so desired, on taking into account the phase relationship which must exist between the angular position of the element which effects the distribution and the lift of the followers to the cam position which effects the pumping stage.

The embodiment illustrated herein adopts certain particular arrangements of component parts, which, however, can widely be changed while reducing to practice what the suggestion of the present invention is, that is, to have an angular speed of the cam members which is faster than the angular speed of the element which, in its rotary motion, acts as a distributing member.

Figure 3:
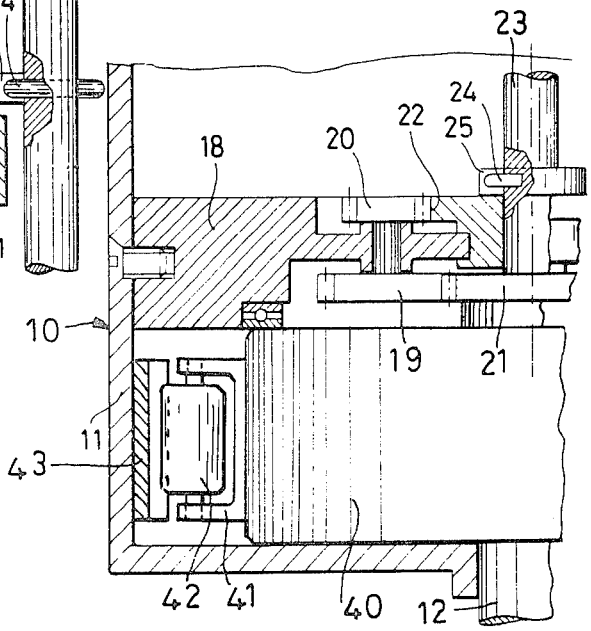

For example, as shown in FIG. 3, the rotary member 23 may fulfil only the task of the fuel distribution while the pumping work can be entrusted to pistons of the radial type. In this case, the pumping unit takes the conventional form indicated at 40 and the projecting elements 41 for driving the pistons are driven by the agency of their followers 42 which roll over an annular race 43. The fuel delivered by the pumping unit through a conduit not shown coaxial with the member 23, is distributed thereby to the several injectors. Appropriate sealing means are provided between the pumping unit 40 and the member 23 which, in the embodiment in point are rotated at different angular speeds.

Figure 4:
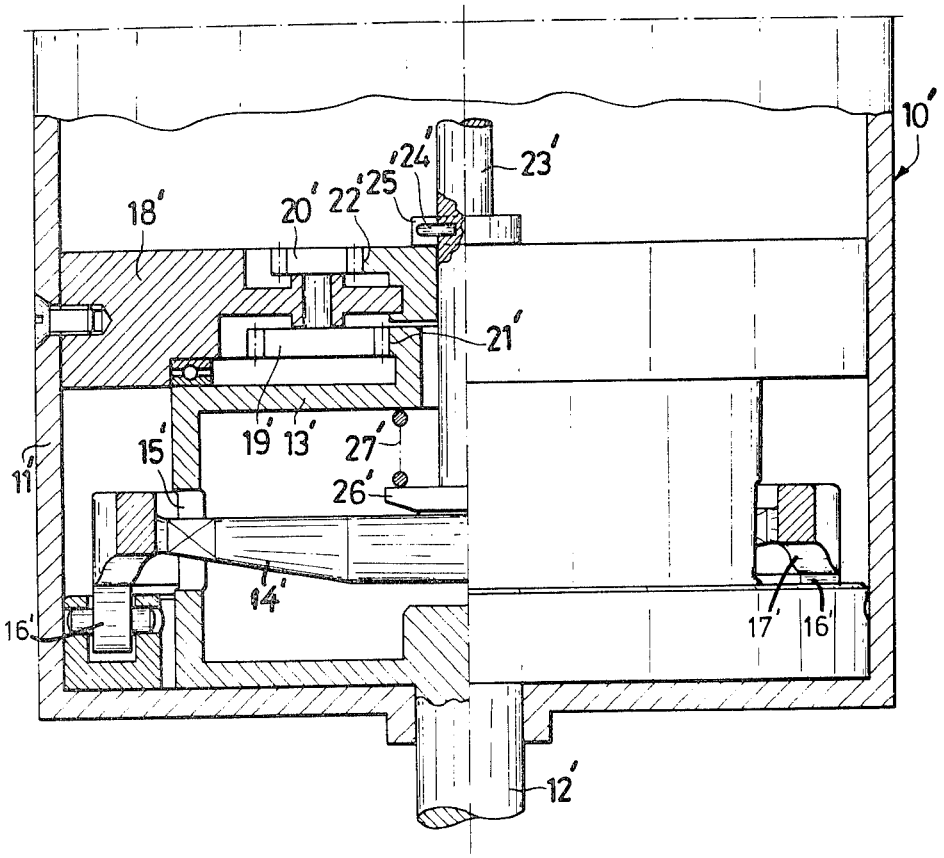
FIG. 4 is a partially cross-sectional view of another pump similar to the pumps of FIGS. 1 through 3, and illustrates further details of another embodiment of the invention.

Another injection pump 10' is shown in FIG. 4 of the drawings and all parts thereof corresponding in structure and function to those of the injection pump 10 of FIG. 1 have been identically numbered and primed (').

In the case of the injection pump 10 of FIG. 1, the arm 14 carries followers 16 which run along a cammed pathway 17 bonded to the pump casing 11, as was earlier described. In the case of the injection pump 10' of FIG. 4, however, the arm 14' carries the cammed pathway or face-cam member 17' while the cam followers or rollers 16' are carried by and affixed to the pump casing or body 11'.

I claim:

1. A fuel distributor injection pump comprising a pumping and distribution piston arranged coaxially with a drive input shaft of the pump and also coaxially with the axis of rotation of face-cam complementary members with which the pump is provided, said piston having a reciprocal axis pumping motion and a rotary motion for distribution of the fuel to the different cylinders of an engine, said drive input shaft being connected to said complementary face-cam members for the purpose of imparting a reciprocal rotating movement to them, said face-cam members controlling said piston to move axially, said fuel distributor injection pump being characterized by the fact that one of the said complementary face-cam members is kinematically connected to said piston by at least one cluster of gears to cause it to rotate with angular velocity less than the reciprocal velocity between the cam members, and the angular translation velocity of the axis of said at least one cluster of gears being not greater than the angular rotation velocity of said pumping and distributing piston.

2. The pump according to claim 1 characterized by the fact that said at least one cluster of gears is of fixed axis type.

3. The pump according to claim 2, characterized by the fact that the drive input shaft entrains into rotation a face-cam member reacting on a system of rollers restrained to the body of the pump, said at least one cluster of gears kinematically connecting the pumping and distribution piston which rests on the cam urged by elastic means to the cam.

4. The pump according to claim 2, characterized by the fact that the drive input shaft entrains in rotation a cam follower reacting on a face-cam race restrained to the body of the pump, said at least one cluster of gears kinetically connecting the pumping and distributing piston which rests thereon urged by elastic means to the cam follower.

5. The pump according to claim 4, characterized by the fact that the cam follower consists of a rotating member in which there are mounted, with transverse axis movable, axially with respect to the said member, a plurality of rollers which rest on a face-cam race, and solidly with said rollers there is formed a support onto which is urged under spring-loading the stem of the pumping and distributing piston, the said member carrying a first ring gear connected by gear couples to a second ring gear rigidly restrained in rotation to said stem of the pumping and distributing piston, but free to move axially on said stem so as allow it an alternating axial travel.

6. The pump according to claim 1, characterized by the fact that said at least one cluster of gears is mounted with its axis on a planet-carrier rotating at the same angular rotation velocity as said pumping and distributing piston so as to form at least one epicyclic gear train.

7. The pump according to claim 6, characterized by the fact that the drive input shaft entrains in rotation a face-cam member reacting on a system of rollers restrained to the body of the pump, said at least one cluster of gears forming a epicyclic train kinematically connecting the pumping and distribution piston, which rests on the cam urged by elastic means, to the cam.

8. The pump according to claim 6, characterized by the fact that the drive input shaft entrains into rotation a cam follower reacting on a face-cam race restrained to the body of the pump, said at least one cluster of gears forming an epicyclic train kinematically connecting the pumping and distribution piston which rests thereon urged by elastic means to the cam follower.

9. The pump according to claim 8, characterized by the fact that the cam follower consists of a rotating member in which there are mounted, with transverse axis movable axially, with respect to the said member a plurality of rollers which rest on a face-cam race, and solidly with said rollers there is formed a support onto which the stem of the pumping and distributing piston is urged by a spring, said member carrying a first ring gear connected by gear couples to a second ring gear rigidly restrained in rotation to the body of the pump, and said gear couples being mounted with their axis on a rotating ring in turn restrained in rotation to said stem of the pumping and distributing piston, but free to move axially on said stem so as to allow it an alternating axial travel.

10. The pump according to claim 1, characterized by the fact that the ratio between the reciprocal angular velocity of the complementary face-cam members and the rotation speed of the pumping and distributing piston is 2.

11. The pump according to claim 2, characterized by the fact that the ratio between the reciprocal angular velocity of the complementary face-cam members and the speed of rotation of the pumping and distributing piston is 2.

12. The pump according to claim 3, characterized by the fact that the ratio between the reciprocal angular velocity of the complementary face-cam members and the speed of rotation of the pumping and distributing piston is 2.

13. The pump according to claim 4, characterized by the fact that the ratio between the reciprocal angular velocity of the complementary face-cam members and the speed of rotation of the pumping and distributing piston is 2.

14. The pump according to claim 5, characterized by the fact that the ratio between the reciprocal angular velocity of the complementary face-cam members and the speed of rotation of the pumping and distributing piston is 2.

15. The pump according to claim 6, characterized by the fact that the ratio between the reciprocal angular velocity of the complementary face-cam members and the speed of rotation of the pumping and distributing piston is 2.

16. The pump according to claim 7, characterized by the fact that the ratio between the reciprocal angular velocity of the complementary face-cam members and the speed of rotation of the pumping and distributing piston is 2.

17. The pump according to claim 8, characterized by the fact that the ratio between the reciprocal angular velocity of the complementary face-cam members and the speed of rotation of the pumping and distributing piston is 2.

18. The pump according to claim 9, characterized by the fact that the ratio between the reciprocal angular velocity of the complementary face-cam members and the speed of rotation of the pumping and distributing piston is 2.

19. The pump according to claim 1 characterized by the fact that the input shaft of the pump is entrained at a speed equal to that of the shaft of the engine fed by said pump.

20. The pump according to claim 2 characterized by the fact that the input shaft of the pump is entrained at a speed equal to that of the shaft of the engine fed by said pump.

21. The pump according to claim 3 characterized by the fact that the input shaft of the pump is entrained at a speed equal to that of the shaft of the engine fed by said pump.

22. The pump according to claim 4 characterized by the fact that the input shaft of the pump is entrained at a speed equal to that of the shaft of the engine fed by said pump.

23. The pump according to claim 5 characterized by the fact that the input shaft of the pump is entrained at a speed equal to that of the shaft of the engine fed by said pump.

24. The pump according to claim 6 characterized by the fact that the input shaft of the pump is entrained at a speed equal to that of the shaft of the engine fed by said pump.

25. The pump according to claim 7 characterized by the fact that the input shaft of the pump is entrained at a speed equal to that of the shaft of the engine fed by said pump.

26. The pump according to claim 8 characterized by the fact that the input shaft of the pump is entrained at a speed equal to that of the shaft of the engine fed by said pump.

27. The pump according to claim 9 characterized by the fact that the input shaft of the pump is entrained at a speed equal to that of the shaft of the engine fed by said pump.

28. The pump according to claim 10 characterized by the fact that the input shaft of the pump is entrained at a speed equal to that of the shaft of the engine fed by said pump.

29. The pump according to claim 11 characterized by the fact that the input shaft of the pump is entrained at a speed equal to that of the shaft of the engine fed by said pump.

30. The pump according to claim 12 characterized by the fact that the input shaft of the pump is entrained at a speed equal to that of the shaft of the engine fed by said pump.

31. The pump according to claim 13 characterized by the fact that the input shaft of the pump is entrained at a speed equal to that of the shaft of the engine fed by said pump.

32. The pump according to claim 14 characterized by the fact that the input shaft of the pump is entrained at a speed equal to that of the shaft of the engine fed by said pump.

33. The pump according to claim 15 characterized by the fact that the input shaft of the pump is entrained at a speed equal to that of the shaft of the engine fed by said pump.

34. The pump according to claim 16 characterized by the fact that the input shaft of the pump is entrained at a speed equal to that of the shaft of the engine fed by said pump.

35. The pump according to claim 17 characterized by the fact that the input shaft of the pump is entrained at a speed equal to that of the shaft of the engine fed by said pump.

36. The pump according to claim 18 characterized by the fact that the input shaft of the pump is entrained at a speed equal to that of the shaft of the engine fed by said pump.

* * * * *